US007866057B2

(12) United States Patent
Grunert et al.

(10) Patent No.: US 7,866,057 B2
(45) Date of Patent: Jan. 11, 2011

(54) DOMESTIC APPLIANCE FOR THE CARE OF WASHED ARTICLES

(75) Inventors: Klaus Grunert, Berlin (DE); Kai Nitschmann, Neuenhagen (DE); Günter Steffens, Dallgow-Döberitz (DE); Andreas Stolze, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 100 days.

(21) Appl. No.: 12/087,168

(22) PCT Filed: Dec. 6, 2006

(86) PCT No.: PCT/EP2006/069359

§ 371 (c)(1),
(2), (4) Date: Oct. 16, 2008

(87) PCT Pub. No.: WO2007/077084

PCT Pub. Date: Jul. 12, 2007

(65) Prior Publication Data

US 2009/0223077 A1 Sep. 10, 2009

(30) Foreign Application Priority Data

Dec. 29, 2005 (DE) ..... 10 2005 062 940

(51) Int. Cl.
*F26B 21/06* (2006.01)
*D06F 58/02* (2006.01)

(52) U.S. Cl. ..... 34/72; 34/73; 34/74; 34/77; 34/78; 34/87; 34/130; 34/134

(58) Field of Classification Search ..... 34/72, 34/73, 74, 77, 78, 87, 130, 607, 134, 138
See application file for complete search history.

(56) References Cited

U.S. PATENT DOCUMENTS

| | | | | |
|---|---|---|---|---|
| 2,749,717 | A * | 6/1956 | Duncan et al. | 62/234 |
| 4,603,489 | A * | 8/1986 | Goldberg | 34/77 |
| 2005/0066538 | A1 | 3/2005 | Goldberg et al. | |

FOREIGN PATENT DOCUMENTS

| | | |
|---|---|---|
| DE | 42 16 106 | 11/1993 |
| DE | 43 06 215 | 9/1994 |
| DE | 43 07 372 | 9/1994 |
| DE | 297 07 322 U | 8/1998 |

(Continued)

OTHER PUBLICATIONS

International Search Report PCT/EP2006/069359.

*Primary Examiner*—Jiping Lu
(74) *Attorney, Agent, or Firm*—James E. Howard; Andre Pallapies

(57) ABSTRACT

A domestic appliance for the care of washed articles having with a container for receiving washed articles; a process air supply which is operationally connected to the container in fluid communication therewith whereby process air flows through the container during appliance operation; and a first heat exchanger which is in fluid communication with the process air supply for dehumidifying the process air exiting the container, the domestic appliance comprising a supplementary heat exchanger for lint filtering operationally disposed in the process air supply in fluid communication with the heat exchanger and the container.

17 Claims, 2 Drawing Sheets

FOREIGN PATENT DOCUMENTS

| | | | | |
|---|---|---|---|---|
| DE | 197 38 735 | | | 3/1999 |
| EP | 0 467 188 | | | 1/1992 |
| EP | 1 055 767 | | | 11/2000 |
| JP | 63-209700 | | | 8/1988 |
| JP | 2001062194 | A | * | 3/2001 |
| WO | WO 2005/080896 | | | 9/2005 |

* cited by examiner 1
2
3
4
5
6
7
8
9
10
11

DOMESTIC APPLIANCE FOR THE CARE OF WASHED ARTICLES

The invention relates to a domestic appliance for the care of washed articles which comprises a container for receiving the washed articles. The container is arranged in a process air supply of the domestic appliance, whereby process air which flows through the process air supply also flows through the container. In addition the domestic appliance comprises a first heat exchanger which is coupled to the process air supply and is designed to dehumidify the process air that exits the container.

BACKGROUND OF THE INVENTION

The term "process air supply" includes both a closed process air circuit and also an open process air supply. The term "domestic appliance for the care of washed articles" includes any appliance which is configured for drying washing with both an vented tumble dryer in which the process air is directed in an open process air supply into the open air after contact with the washing and also a condenser dryer in which the process air is directed in a closed process air circuit. The process air supply is to be taken below as especially to include all air channels and components through which process air flows during operation.

A domestic appliance embodied as a domestic tumble dryer is known from EP 1 055 767 B1. This has a fan in order to generate a flow of process air within a supply, with said air flow being brought into contact within a drying chamber with the washing to be dried for receiving moisture. The domestic appliance also includes devices for introducing a liquid into a section of the process air supply or extracting it from said section. Furthermore the domestic appliance features a controller which is embodied such that, in a cleaning phase, with the fan switched off, a section of the process air supply is divided off by means of a closure device and at least partly flooded for a specific period with a liquid which is then removed at the end of the cleaning phase from the flooded section of the process air supply. Arranged in the section to be flooded can be a heat exchanger for condensing the moisture contained in the process air on which lint and contaminants have been deposited which are to be removed by the flooding.

Known from EP 0 467 188 B1 is a domestic appliance in the form of a tumble dryer which is equipped for reducing energy consumption with a compressor heat pump. In such a tumble dryer lint which the process air takes away from the washed articles to be dried represents an especial problem since the fine structures of the components through which the process air flows, especially the evaporator, the condenser of the heat pump, are especially susceptible to becoming blocked by fine lint which cannot be completely captured by a conventional lint filter.

Although a lint filter is usually provided, small particles or fine lint can still reach components of the heat pump during operation and be deposited there. In addition to the ongoing cleaning of the lint filter, in practice the process air supply must thus be cleaned at regular intervals. This however demands a large amount of effort since the heat exchangers especially are fixed relatively permanently in the domestic appliance.

SUMMARY OF THE INVENTION

The object of the present invention is thus to create a domestic appliance for the care of washed articles in which the accumulation of lint on means for dehumidifying a process air flow can be reduced.

The object is achieved by a domestic appliance which has the features of the exemplary embodiments disclosed herein.

The inventive domestic appliance for the care of washed articles has a container for receiving washed articles, especially a drum, which is arranged in a process air supply. The container is in connection with the process air supply such that process air flowing through the process air supply also flows through the container. In addition the domestic appliance has a first heat exchanger which is coupled to the process air supply and is embodied for dehumidifying the process air exiting the container. An important idea is that a supplementary heat exchanger for lint filtering is arranged in the process air supply.

This embodiment results in reliable filtering out of fine lint in the process air flow by the supplementary heat exchanger and thus of the lint no longer being able to adhere to the actual means for dehumidifying the process air exiting the container. The supplementary heat exchanger slightly cools off the process air flowing through it and causes a small amount of condensation in the process air, however expediently as much as is required to bind fine lint which the process air is carrying along with it and which especially is not able to be captured by a conventional lint filter provided before the supplementary heat exchanger.

Preferably the supplementary heat exchanger is arranged in the direction of the process air flow before the means for dehumidifying the process air.

Preferably cooling elements of the working medium circuit of the domestic appliance are arranged positioned against an outer side of the supplementary heat exchanger. In such an embodiment the supplementary heat exchanger is coupled directly to the working medium circuit or is arranged in the latter. This type of outside positioning or contacting of the cooling elements with the supplementary heat exchanger means that these cooling elements do not penetrate into this supplementary heat exchanger itself.

Preferably the supplementary heat exchanger is arranged to form a positive and/or non-positive fit with the cooling elements. On the one hand this enables an effective cooling and on the other hand a mechanically stable connection.

Preferably the supplementary heat exchanger is mechanically connected to a pre-tensioning device, which can especially be a spring element. This pre-tensioning device is arranged and embodied such that it presses the supplementary heat exchanger onto the cooling elements. This makes for a positionally stable arrangement of the supplementary heat exchanger in the process air supply and also makes for good contacting with the cooling elements. Thus the supplementary heat exchanger can be removed and replaced quickly and with little effort in the domestic appliance. This makes cleaning it a very easy operation. The positive connection also always ensures sufficient contact after the supplementary heat exchanger has been replaced in the domestic appliance.

Preferably a lint filter is arranged in the direction of the process air stream in front of the supplementary heat exchanger. A relatively low cooling power is sufficient to achieve a small but adequate condensation of the moist process air for capturing the lint from the drum filled with damp washing between the exit from the drum and the entry into the first heat exchanger.

Especially preferably the supplementary heat exchanger is arranged and attached such that it is able to be removed from the domestic appliance without using a tool. This make possible uncomplicated removal and cleaning by a person operating the domestic appliance; An intervention of a specialist with particular training and equipped with a suitable tool within the framework of costly maintenance is no longer necessary.

In a preferred manner the domestic appliance is embodied as a tumble dryer.

The fact that the supplementary heat exchanger is not rigidly fixed into the domestic appliance makes simple and uncomplicated removal of the supplementary heat exchanger from the domestic appliance and especially from the working substance circuit possible. However the positive and/or non-positive connection with the working substance circuit still allows stable positioning. The non-fixed mounting of the supplementary heat exchanger has a significant advantage, since the supplementary heat exchanger must be flushed out at regular intervals by a liquid, especially water, and is easy to remove for this purpose and can be thus be easily cleaned with little effort.

BRIEF DESCRIPTION OF THE DRAWINGS

Exemplary embodiments of the invention are explained in greater detail below with reference to the schematic drawing. The figures show.

DETAILED DESCRIPTION OF THE EXEMPLARY EMBODIMENTS OF THE PRESENT INVENTION

In the figures the same elements or those with the same function have been labelled with the same reference symbols.

Figure 1:
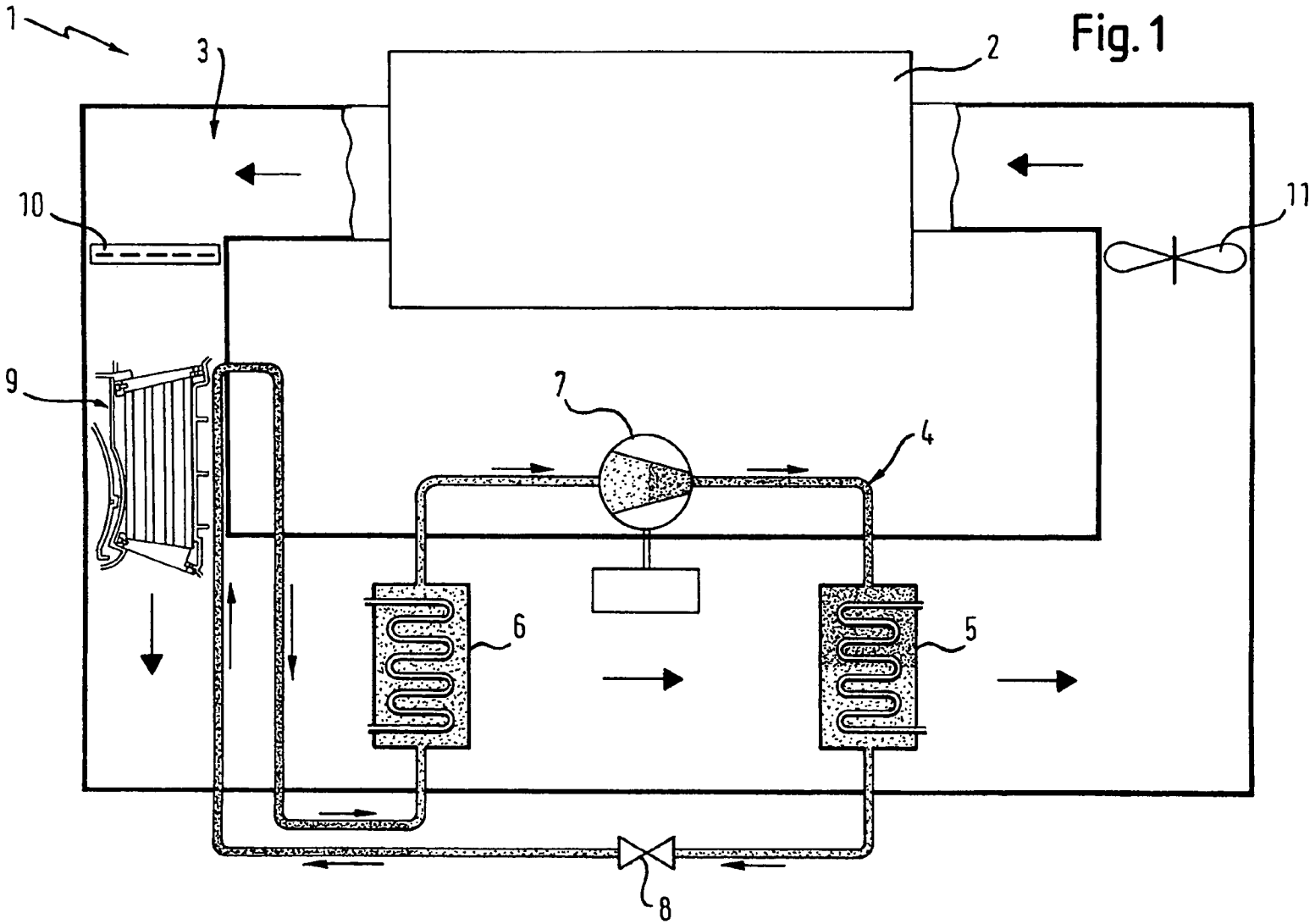
FIG. 1 a schematic diagram of a tumble dryer.

Shown in a schematic block diagram in FIG. 1 are the elements of a domestic appliance 1 for the care of washed articles of importance for the present explanation. The domestic appliance for the care of washed articles is embodied as tumble dryer 1. The tumble dryer 1 is embodied as a recirculating air dryer and comprises a container 2 for receiving washed articles. The container 2 is arranged in a process air supply 3, which in the exemplary embodiment is embodied as a process air circuit. 3 In this case the process air flowing in the process air circuit 3 also flows through the container 2.

The dry air or process air directed through the container 2 is heated up before entering the drum or the container 2 by a second heat exchanger 5, which serves as an evaporator 5 for a working substance circulating in the working substance circuit, and if necessary by an additional heating device not shown here and after exit from the container 2, for condensation of humidity contained in the process air, is cooled by a first heat exchanger which serves as an evaporator 6 for the working substance circulating in the working substance circuit 4. The process air is driven by a fan 11 and flows in the direction of the arrows through the process air circuit 3. Within the container 2 the heated process air comes into contact with the washing to be dried and in doing so removes moisture from it.

The working substance circuit 4 is thermally coupled to the process air circuit 3 via the condenser 5, the evaporator 6 and a supplementary heat exchanger 9 to be described below, which has the function of an additional evaporator 9. The working substance circuit 4, with the condenser 5, the evaporator 6, the supplementary heat exchanger 9 as well as a compressor 7 and a choke 8 forms a heat pump 4, 5, 6, 7, 8, 9. The condenser 5 is arranged after the compressor 7 and thereby arranged on the pressure side. The choke 8 arranged after the condenser 5 and before the evaporator 6 in the working substance circuit 4 causes a drop in pressure necessary for the vaporization of the working substance between the condenser 5 and the evaporator 6. In the evaporator 6 as much heat is removed from the process air as to condense out the moisture contained within it received into the drum 2; The condensate is extracted and taken away from the process air by a device at the evaporator 6 known per se and not shown in FIG. 1.

The supplementary heat exchanger 9 is arranged in the process air circuit 3. It is embodied for lint filtering and is positioned in the direction of the process air flow before the first heat exchanger 5 and the second heat exchanger 6. It cools down the process air flowing through by a small amount and causes slight condensation in the process air, but only enough as is required to bind small particles of lint which the process air is carrying out of the drum 2 and which cannot be captured by a lint filter 10 known per se arranged in the process air circuit 3 before the supplementary heat exchanger 9.

Figure 2:
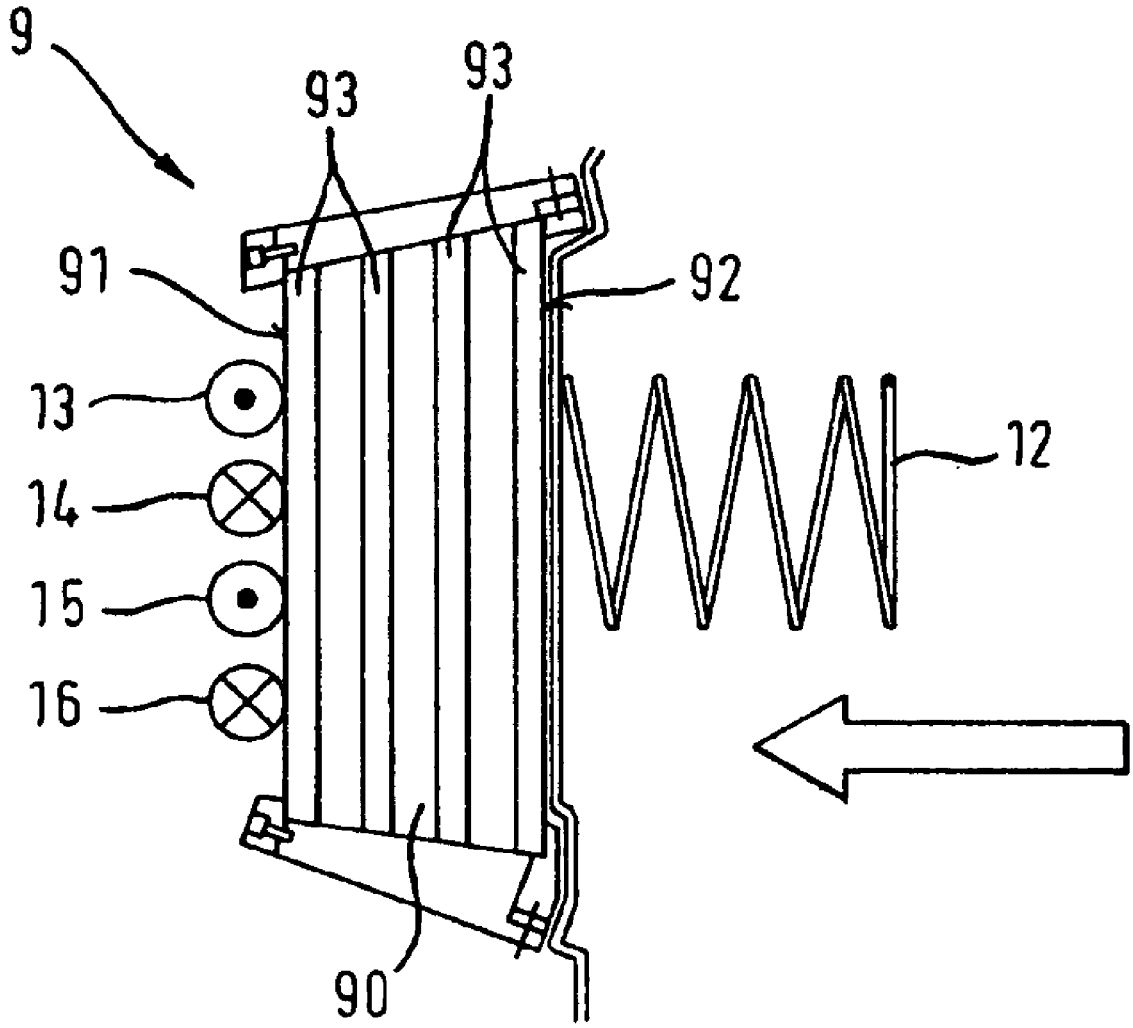
FIG. 2 a cross-sectional view of a supplementary heat exchanger of the tumble dryer.

FIG. 2 shows a cross-sectional view which depicts the arrangement of the supplementary heat exchanger 9 in the process air circuit 3. Cooling elements 13, 14, 15 and 16 are positioned on the first outer side 91 of the supplementary heat exchanger 9. The first outer side 91 faces away from the flowing process air during operation. The cooling elements 13 to 16 are part of a pipe section laid in a serpentine shape and through which the working substance flows. The supplementary heat exchanger is constructed from a plurality of plates 90, which are stacked on each other perpendicular to the plane of the drawing while leaving space for the process air 3 flowing in the direction of the arrows. FIG. 2 shows such a plate 90. The structures 93 protruding from the plate 90 form channels or guides for the process air and enlarge the surface to which lint can adhere. The supplementary heat exchanger 9 is pressed by a spring element 12 lying against a second outer side 92 opposite the first outer side 91 with the first outer side 91 being pressed onto the cooling elements 13 to 16. The spring element 12 is for example supported or attached on an inner wall of a channel of the process air circuit 3 and creates a pre-tensioning force which presses the supplementary heat exchanger 9 onto the cooling elements 13 to 16. The supplementary heat exchanger 9 is connected with a positive or non-positive fit to the cooling elements 13 to 16, which guarantees effective thermal coupling. The plates are made of aluminum or any other material with good thermal conductivity.

In operation of the tumble dryer 1 the supplementary heat exchanger 9 will be cooled by the working substance flowing through the cooling elements 13 to 16, so that it causes a small amount of condensation in the process air flowing past. Fine lint, which is bound by condensate formed at the supplementary heat exchanger 9 in this manner, adheres to the plates 90. Because of its previously described design the supplementary heat exchanger 9 can be simply removed from the process air circuit 3 and can thus be easily cleaned in order to remove fine lint deposited on the plate 90. The supplementary heat exchanger 9 thus simply and reliably prevents a contamination of the evaporator 6 which comes after it in the process air circuit 3, which in accordance with the prior art is relatively finely structured and thus relatively susceptible to contamination by lint. There is also the fact that it is hardly to be expected that an evaporator 6 in a tumble dryer 1 will be cleaned by a person who normally operates the tumble dryer 1. Instead such a task is to be handled by a person who is trained to maintain and repair such a tumble dryer 1 within the framework of customer service. The tumble dryer 1 described here with supplementary heat exchanger 9 on the other hand avoids the necessity of calling on customer service to clean out fine lint from the appliance, in that the supplementary heat exchanger 9 is able to be removed without using a tool, in the same way as the lint filter 10 in accordance with known practice.

The invention claimed is:

1. A domestic appliance for the care of washed articles comprising:

a container for receiving washed articles;

a process air supply which is operationally connected to the container in fluid communication therewith whereby process air flows through the container during appliance operation;

a first heat exchanger in fluid communication with the process air supply for dehumidifying the process air exiting the container;

a second heat exchanger in fluid communication with the process air supply for heating the process air in the process air supply;

a heat pump with a working substance circuit whereby a working substance flows through the working substance circuit, wherein the first heat exchanger forms an evaporator of the heat pump, and the second heat exchanger forms a condenser of the heat pump; and a supplementary heat exchanger for lint filtering operationally disposed in the process air supply in fluid communication with the first heat exchanger and the container, wherein cooling elements of the working substance circuit lie against an outer side of the supplementary heat exchanger, and wherein the supplementary heat exchanger is mechanically connected with a biasing element that presses the supplementary heat exchanger onto the cooling elements.

2. The domestic appliance according to claim 1 wherein the supplementary heat exchanger is disposed upstream of the first heat exchanger.

3. The domestic appliance according to claim 1, wherein the supplementary heat exchanger functions as an additional evaporator and is operationally associated with the working substance circuit.

4. The domestic appliance according to claim 3 wherein the supplementary heat exchanger is connected in the working substance circuit in series with the evaporator.

5. The domestic appliance according to claim 1, wherein the supplementary heat exchanger makes at least one of a positive and a non-positive fit with the cooling elements.

6. The domestic appliance according to claim 1 wherein a lint filter is arranged in the direction of the process air flow upstream of the supplementary heat exchanger.

7. The domestic appliance according to claim 1 wherein the supplementary heat exchanger can be removed without using a tool.

8. The domestic appliance according to claim 1 wherein the domestic appliance includes a tumble dryer.

9. The domestic appliance of claim 1, wherein the biasing element is a spring.

10. The domestic appliance of claim 1, wherein the biasing element is attached on one end to the supplementary heat exchanger and on another end to an inner wall of the process air supply.

11. The domestic appliance of claim 1, wherein the supplementary heat exchanger has a second outer side that is opposite the outer side, and wherein the biasing element presses against the second outer side of the supplementary heat exchanger such that the outer side of the supplementary heat exchanger is pressed against the cooling elements.

12. The domestic appliance of claim 11, wherein the biasing element is a spring attached on a first end to the second outer side of the supplementary heat exchanger and on a second end to an inner wall of the process air supply.

13. The domestic appliance of claim 1, wherein a lint filter is arranged in the direction of the process air flow upstream of the supplementary heat exchanger, and wherein the supplementary heat exchanger is disposed between the lint filter and the first heat exchanger for filtering lint from the process air before the process air flows over the first heat exchanger.

14. The domestic appliance of claim 1, wherein the supplementary heat exchanger includes a plurality of plates stacked on each other and lying in a plane parallel to a direction of flow of the process air through the process air supply and having spaces therebetween, whereby the process air flows through the spaces.

15. The domestic appliance of claim 14, wherein each of the plurality of plates includes one of a channel and a guide for guiding the process air and for capturing lint on a surface of the one of the channel and the guide.

16. The domestic appliance of claim 1, wherein the cooling elements of the working substance circuit lie against the outer side of the supplementary heat exchanger without penetrating into the supplementary heat exchanger.

17. The domestic appliance of claim 1, wherein the supplementary heat exchanger is removable from within and replaceable back into the process air supply for cleaning lint from surfaces of the supplementary heat exchanger.

* * * * *